US006701842B2

(12) United States Patent
Hartmann et al.

(10) Patent No.: US 6,701,842 B2
(45) Date of Patent: Mar. 9, 2004

(54) PROCESS FOR THE TREATMENT OF AN ERASABLE LITHOGRAPHIC PRINTING PLATE

(75) Inventors: Thomas Hartmann, Neusäss-Westheim (DE); Josef Schneider, Diedorf (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/002,301

(22) Filed: Nov. 2, 2001

(65) Prior Publication Data

US 2002/0096074 A1 Jul. 25, 2002

(30) Foreign Application Priority Data

Nov. 2, 2000 (DE) ..... 100 54 284

(51) Int. Cl.[7] ..... B41C 1/10; B41N 3/08
(52) U.S. Cl. ..... 101/467; 101/478; 510/171
(58) Field of Search ..... 101/456, 457, 101/462, 463.1, 465, 466, 467, 478; 430/302; 510/170, 171

(56) References Cited

U.S. PATENT DOCUMENTS 4,101,322 A * 7/1978 Lawson ..... 101/466
4,214,531 A 7/1980 Garrett et al.
4,233,110 A * 11/1980 Richter et al. ..... 101/465
4,846,065 A * 7/1989 Mayrhofer et al. ..... 101/467
4,958,564 A * 9/1990 Fuhrmann et al. ..... 101/467
4,968,584 A * 11/1990 Nagashima et al. ..... 101/466
4,983,478 A * 1/1991 Stahlhofen et al. ..... 101/463.1
5,045,697 A * 9/1991 Schneider ..... 101/487
5,213,950 A * 5/1993 Dooley ..... 101/463.1
5,238,778 A * 8/1993 Hirai et al. ..... 101/467
5,382,964 A * 1/1995 Schneider ..... 101/467
5,615,613 A * 4/1997 Hattori et al. ..... 101/450.1
6,190,828 B1 * 2/2001 Verschueren et al. ..... 430/302
2001/0008877 A1 7/2001 Hartmann et al.

FOREIGN PATENT DOCUMENTS

DE 42 16 636 A1 11/1993
DE 44 26 012 A1 1/1996
EP 0 965 444 A1 12/1999

* cited by examiner

*Primary Examiner*—Stephen R. Funk
(74) *Attorney, Agent, or Firm*—Cohen, Pontani, Lieberman & Pavane

(57) ABSTRACT

A process for treating a used or unused printing plate with an erasing composition to clean the printing plate, laser imaging the printing plate with a polymeric substance, and to provide art image thereon, and fixing the image on the printing plate. Further, the printing plate has applied thereto any one of a heat-curable and water-soluble substance, if desired, immediately after the laser imaging, or a water-soluble substance immediately after the laser imaging, followed by warming of the printing plate. The water-soluble substance or the heat-curable and water-soluble substance is washed off using a solution essentially consisting of water before printing.

25 Claims, No Drawings

PROCESS FOR THE TREATMENT OF AN ERASABLE LITHOGRAPHIC PRINTING PLATE

BACKGROUND OF THE INVENTION

1. Field of the Invention

The present invention relates to a process for the treatment of an erasable lithographic printing plate. In particular, the present invention relates to a process for the treatment of an erasable lithographic printing plate after imaging or fixing with an agent which provides the imaged printing plate with favourable properties.

2. Description of the Related Art

Digital direct imaging of printing plates has rapidly developed in the last decade into an essentially independent sub-area of printing processes. This technique combines the advantages of digital technology with traditional printing technology. This combination makes it possible to image the printing plate directly from digital integrated word/image processing and to run off small- to medium-run orders in the shortest possible time. A crucial breakthrough was achieved in this connection with an erasable printing plate which remains in the printing machine and can be erased, prepared and re-imaged digitally in the shortest possible time without manual intervention. In order that these operations can proceed without manual intervention in the printing machine, for example installation and removal of the printing plate, substantial automation or control of the individual steps, such as erasure of the printing plates, imaging, fixing, preparation and conditioning, is necessary. This in turn, in contrast to conventional printing technology, requires a different and specific choice of the materials used, for example those of the printing plate, the erasing composition, the imaging material and other necessary auxiliaries.

In the printing process of the generic type, in which a printing-plate cylinder is provided with plastic in a punctiform and imagewise manner, this printing-plate cylinder is then coated with printing ink for an offset process, and the printing ink in the ink-carrying areas is taken up by a rubber roll and transferred to the material to be printed. The process of printing-ink acceptance by the printing-plate cylinder is based on an awkward interaction between hydrophilic areas of the printing-plate cylinder which repel the printing ink (in the present case the non-imaged areas—in the case of a metal printing plate the metal surface) and the ink-carrying areas, in the present case the imaging with polymeric material. In order that this distinction-based mechanism also proceeds sharply and clearly in the edge zones of the image, i.e. in the transition between the metal surface and the imaging layer, clean phase separation between oleophilic printing ink and damping solution must occur in this area. It has been found that, in the process of the generic type, residue particles from the image are present, in particular in this area, these residue particles presumably being ash constituents, separated-out constituents or sprayed constituents of the donor layer of the thermal transfer ribbon used for the imaging. In a conventional process, the following procedure has hitherto been followed. The printing plate was treated with a cleaning agent consisting of two different components. The first component firstly substantially dissolved the oleophilic part, i.e. the printing ink, of the used printing plate. The second component then dissolved the image from the printing plate. Since the image is a substance which is soluble in water at a certain pH, the two components are inevitably incompatible with one another to a certain extent. This means that on use of the second component, slight traces of the oleophilic residues which have not been removed in the first operation cannot be removed, and thus the first component of the erasing composition is used again in order that the printing-plate surface can be fully cleaned of the image, including the printing ink located on the image. This interplay has to be carried out a number of times in stubborn cases. After cleaning, the printing-plate surface is sufficiently hydrophilized for imaging to take place. This is followed by fixing, i.e. warming of the image in order to gain chemical and physical influence on the primary substance making up the image, for example surface treatment of the pixel surface, stronger adhesion to the printing plate, levelling of the pixels, etc. In conventional printing plates, which are handled manually, a rubber layer is generally applied after fixing in order to preserve the printing-plate surface prepared for printing and to protect it, for example against fingerprints. In printing processes which use an erasable lithographic printing plate, this is not really necessary since in the case of print on demand, the next print order is generally carried out and executed immediately after the preceding one. In the case of the process with an erasable lithographic printing plate, conditioning is generally carried out immediately before printing. This conditioning step firstly has the aim of hydrophilization of the non-ink-carrying areas, i.e. restoring the surface quality of these parts, which may have been impaired by the processes of imaging and/or fixing. The second aim is to remove the abovementioned residues located in the edge regions of the pixels and formed during imaging. For this purpose, the acidic component of the abovementioned two-part cleaning medium is used. The acidic component contains phosphoric acid, which, for example, adequately hydrophilizes the metal surface of the printing plate, and it contains a certain very fine abrasive, which is intended to remove the residues in the edge regions. It has now been found that the use of this agent not only removes the residues in the edge regions, but the abrasive action also acts on the polymer material and can thus affect the habit of the pixels which later carry ink.

SUMMARY OF THE INVENTION

The object of the present process is to simplify the sequence of the known process for printing using an erasable lithographic printing plate, in particular during cleaning of the printing plate, namely to achieve the simplest and gentlest possible removal or encapsulation of the residues in the edge regions of the image pixels which does not significantly affect the shape of the pixels, including their surface nature, and adequately hydrophilizes the metal surface. In particular, it is an object of the present invention to provide a simpler cleaning programmed without alternating ink and imaging/erasure sequences. Furthermore, re-deposition of, for example, ink residues which are only soluble in one of the two components in a conventional erasing composition should be avoided. Furthermore, the disadvantage that the current conditioning step has to take place immediately before printing should be overcome in that the printing plate can be employed at any desired point in time, i.e. even after a print stop.

It has now been found that the abovementioned object can be achieved by the use of a heat-curable and water-soluble substance or of a water-soluble substance which has been applied to the printing plate after imaging or after fixing and is washed off with a solution essentially consisting of water immediately before printing.

A further aspect consists in that a one-component cleaning solution is used instead of the two-component cleaning solution. In the case of the two-component cleaning solution, a metal surface which has been essentially hydrophilized on the printing plate by means of phosphate residues is provided before the imaging through the use of the acidic component as the final component. On use of a one-component cleaning solution, an essentially alkaline cleaning solution is used which leaves behind a metal surface provided with oxide or hydroxide groups. This surface appears to have the advantage that strong re-hydrophilization, as in conventional processes due to the re-use of an acidic component containing abrasive elements, is unnecessary.

Surprisingly, it has been found that printing plates having the same print quality as in complex known processes can be achieved through the use of the heat-curable and water-soluble substance used in the invention or of the water-soluble substance used in the invention.

Consequently, the object on which the invention is based is achieved by a process for the treatment of an erasable lithographic printing plate, in which the process comprises the following steps:

(a) treatment of a used or unused printing plate with an erasing composition, (b) laser imaging of the printing plate with a polymeric substance, and (c) fixing of the imaged printing plate, and is characterized in that the printing plate is provided (i) with a heat-curable and water-soluble substance, if desired, immediately after step b), or (ii) with a water-soluble substance immediately after step b), or (iii) with a heat-curable and water-soluble substance immediately after step b), followed by warming of the printing plate, and the water-soluble substance or the heat-curable and water-soluble substance is washed off using a solution essentially consisting of water before printing.

The Steps (a) treatment of a used or unused printing plate with an erasing composition, (b) laser imaging of the printing plate with a polymeric substance, and (c) fixing of the imaged printing plate can be carried out in a manner known per se. In step (a), an advantage arises, as stated above, on use of an alkaline erasing composition consisting of only one component. The abovementioned step (i), (ii) or (iii) is carried out by means of a cloth-based cleaning device or takes place via a spray device. By contrast, conventional rubber coatings are applied via rubber rolls in order to achieve a uniform film. It has been found that this is disadvantageous in the case of printing plates which have been imaged by means of a laser and a thermal transfer ribbon as donor and then optionally fixed. Alternatively, application can take place via a media nozzle directly onto the printing-plate cylinder.

The object of the present invention is also achieved by a process for the treatment of an erasable lithographic printing plate including the steps:

(a) treating one of a used and an unused printing plate with an erasing compound to clean the printing plate;

(b) laser imaging the printing plate with a polymeric substance to provide an image thereon;

(c) applying to the printing plate any one of (i) a heat-curable and water-soluble substance one of immediately before step b), and immediately before step c), (ii) a water-soluble substance one of immediately before step b) and immediately before step c), and (iii) a heat-curable and water-soluble substance one of immediately before step b) and immediately before step c), followed by warning of the printing plate, the water soluble and heat curable substance being applied with one of an application cloth, an elastic rubber roll, and a media nozzle;

(d) fixing the image on the printing plate; and (e) washing the water-soluble, or the heat curable and water substances from the printing plate with a solution consisting essentially of water before printing with the printing plate.

The various features of novelty which characterize the invention are pointed out with particularity in the claims annexed to and forming a part of the disclosure. For a better understanding of the invention, its operating advantages, and specific objects attained by its use, reference should be had to below described preferred embodiments of the invention.

DETAILED DESCRIPTION OF THE PRESENTLY PREFERRED EMBODIMENTS

It has been found that the water-soluble substance used can be a substance which comprises at least one of the following components:

polysaccharides, in particular maltodextrins and/or tapioca dextrins;

polyalkylene glycols, in particular PEG having an MW of from 200 to 1000;

(meth)acrylamide polymer, in particular partially hydrolysed, having an MW of from 100,000 to 300,000 and a proportion of 60–70% of hydrolysed acrylic groups;

polyvinylpyrrolidone;

vinyl methyl ether-maleic anhydride copolymer;

vinyl acetate-maleic anhydride copolymer;

and, if desired, comprises one or more of the following further components:

wetting agents, such as oligomeric poly(ethylene glycol), octylphenoxypolyethoxyethanol (optionally sulphonated), nonylphenolpolyethoxyethylene glycol (optionally sulphonated);

nonionogenic surfactants, such as ethoxylated decyl alcohols, polyethoxylated nonylphenol, polyethoxylated isooctylphenol, ethoxylated sorbitan monooleate, propoxylated isooctylphenol, anionic surfactants, such as alkali metal salts of alkanol sulphates, such as sodium lauryl sulphate, alkali metal salts of alkylaryl sulphates and sulphonates, such as sodium alkylnaphthalenesulphate, sodium alkylnaphthalenesulphonate and sodium alkylbenzenesulphonate, plasticizers, such as dialkyl phthalates.

These substances must not contain any substances that might impair the image or render it unusable in the printing process of the generic type. Substances of this type are, for example, lower glycols or polyvinyl alcohol, which will probably adhere to the metal surface due to complex formation and thus interfere with the desired sharp phase separation between the oleophilic printing ink and the damping solution. Prints with a background haze may be obtained in this case. Further substances which may impair the imaging in the printing process of the generic type or render it unusable are substances which dissolve or decompose the polymer. In the case of imaging with a polymeric substance which is soluble in alkalis, soluble substances which would be present in the water-soluble substance would then impair, in the worst case dissolve, the polymeric substance used as ink-carrying layer. Further substances which impair the imaging in the printing process of the generic type, or render it unusable, are so-called refatting components and neutral rubber coatings which are provided for treating the ink-carrying coatings. Caustic rubber coatings, which are employed, in particular, in the case of aluminium printing plates, may also destroy the image.

In this description, the water-soluble substance means both a single substance and a substance mixture. The water-soluble substance may contain various additives which accelerate detachment of the substance liberated after application to the printing plate during removal before printing. In addition, substances may be present which provide the certain polymeric substances used as water-soluble substance with elasticity.

In the case of polyethylene glycols, PEG having a molecular weight of from 200 to 1000, preferably from 200 to 800, more preferably from 200 to 600, in particular from 200 to 400, can be used.

Water-soluble substances which can be used are commercially available rubber coatings or bake-on rubber coatings. These contain, for example, polysaccharides, in particular maltodextrins and/or tapioca dextrins, but also, for example, natural gums, such as gum arabic. Rubber coatings which contain so-called refatting components and so-called neutral rubber coatings and caustic rubber coatings generally cannot be used.

So-called bake-on rubber coatings post-polymerize somewhat or solidify with formation of greater hardness, while not losing their ability to re-dissolve in aqueous media.

The printing plate is generally thin and coated with the water-soluble substance or the heat-curable, water-soluble substance and dried using cold air or with moderate heat. Elevated temperatures and excessively thick layer formations are undesired, since otherwise the layer could burst and the printing layer be damaged.

The conventional rubber-coating compositions are generally colloidal solutions having strongly hydrophilic properties.

On use of aluminium printing plates which have, in microscopic terms, a very fissured surface, rubber coatings generally dry to give a hard coating on the printing plate. Even after the printing plate has been washed off with water, a very fine residual layer therefore remains in the capillaries and facilitates good wetting with the damping solution, since the rubber-coating compositions are generally strongly hydrophilic. In the present process for the treatment of an erasable lithographic printing plate, however, a printing plate is generally employed which does not consist of aluminium, but instead of a material which, in microscopic terms, has a very smooth, unfissured surface, namely a polished metal or glass surface. These surfaces do not retain the conventional rubber-coating compositions as residual layer, but instead the conventional rubber-coating compositions are very substantially washed off completely on these surfaces. The printing plate can be made from a plasma or a flame sprayed ceramic. It may have a metal surface such as of chrome, brass or stainless steel.

The water-soluble substance or the heat-curable and water-soluble substance should be selected from the above-mentioned materials in such a way that it can be readily rinsed off without mechanical action using a solution essentially consisting of water. In addition, it should have adequate tack. The tack presumably results in it being possible for the fine particles or microparticles present in the edge zones of the pixels to be surrounded or encapsulated and removed. In the conventional process, an abrasive element having at least the size of the particles to be removed would normally be necessary for this purpose. The finer the abrasive particles in the conventional hydrophilization or conditioning liquid, the sharper the region between the ink-carrying polymeric composition and the exposed metal layer could be made. However, the smaller the abrasive particles, the less is also the action of detaching fine particles or microparticles from the surface. The mechanism of surrounding or encapsulation and simultaneous detachment of the fine residual particles in the edge regions of the pixels which is presumed in the present case appears to result in thorough removal of these residual particles from the printing-plate surface.

The surrounding or encapsulation of the interfering and generally hydrophobic (for example oleophilic) residues results in hydrophilization of the encapsulated particles in question. Such an encapsulation has a structure which is very similar to that of a micelle. The oleophilic or hydrophobic particle adhering to the printing plate, in particular in the edge region of the pixels, forms the core of the "micelles", while the hydrophilic rubber coating encapsulates it and thus renders it soluble for hydrophilic solvents, such as water. These "micelles" can then be removed significantly more simply and in the most favourable case without the use of abrasive elements. The entire operation can be carried out by machine and automatically.

In the printing process of the generic type for imaging using a laser, use is made of a polymeric substance which comprises the following components:

(1) a substance which is able to convert the radiation energy of the incident laser light into heat energy, (2) a polymer which contains acidic groups and/or optionally substituted amide groups thereof, and (3) if desired a wetting aid.

Component (i) Itself Comprises (4) an organic dye or an organic colorant having at least the following properties:

4.1 absorption maximum in the wavelength range from 700 to 1600 nm, 4.2 a heat resistance of greater than 150° C. and (5) an inorganic substance which is able to convert radiation energy into heat energy without decomposing, and/or (6) a type of carbon.

The organic dye or organic colorant used for the imaging comprises heat-stable organic dyes or pigments selected from benzothiazoles, quinolines, cyanine dyes or pigments, perylene dyes or pigments and polymethine dyes or pigments, such as oxonole dyes and pigments, or merocyanine dyes and pigments.

The polymer of the donor layer of the thermal transfer ribbon used for laser imaging executes, in particular, the following functions. Firstly, it will rapidly soften on exposure to the laser beam, will develop the necessary pressure at the interface with the substrate layer, and will transfer as a semi-solid graft to the printing-plate cylinder. There, the plastic transferred in this way adheres, owing to hydrophilic groups, to the hydrophilic surface of the printing-plate cylinder. Finally, the polymer should firstly survive a fixing step by warming and then a hydrophilization step of the finished printing-plate cylinder. In this step, the free metal areas of the printing-plate cylinder are hydrophilized, and the plastic areas on the printing-plate cylinder are profiled.

In addition, the plastic now located on the printing-plate cylinder should be able to accept printing ink and should have the longest possible service life. Finally, the transferred composition should be rinsed off the printing-plate cylinder in a simple and environmentally friendly manner, i.e. if possible using an aqueous, non-toxic solution, when the printing operation is complete, so that the printing-plate cylinder is available again for the next operation in a very short time. Owing to these requirements, the following preferred demands arise for the polymer. The polymers are soluble in aqueous solution, but insoluble in the fountain solution normally used in offset paper printing. This is best achieved by rendering the polymer water-soluble for a pH differing from the fountain solution. Preference is given to an alkaline range having a pH of greater than 10, preferably 10.5, in particular greater than 11.

In order that the polymer can be detached from the substrate or support, its number average molecular weight should preferably not exceed 20,000. On the other hand, its number average molecular weight should preferably not be less than 1000, since otherwise adequate water resistance is not achieved. The range is preferably between 1000 and 15,000, in particular between 1000 and 10,000.

The polymers must accept printing ink. A surface tension of preferably between 50 and 10 mN/m, in particular between 40 and 23 mN/m, particularly preferably in the range from 28 to 32 mN/m, is of importance for this purpose. The surface tension is measured via contact angle measurement with 3+n test liquids and is evaluated by the method of Wendt, Own and Rabel.

In order that the transferred polymer adheres adequately to the hydrophilic printing-plate cylinder, it preferably contains acidic groups. These groups may be selected from the groups —COOH, —$SO_3H$, —$OSO_3H$ and —$OPO_3H_2$ and the unsubstituted or alkyl- or aryl-substituted amides thereof. The alkyl group can have from 1 to 6, preferably from 1 to 4, carbon atoms, and the aryl group can have from 6 to 10, preferably 6, carbon atoms. In addition, the polymer preferably contains an aromatic group. Preference is given to phenyl groups. The polymer preferably originates from the polymerization of α,β-unsaturated carboxylic, sulphonic, sulphuric and phosphoric acids or esters or the above-defined amides thereof and styrene, and derivatives thereof, and optionally α,β-unsaturated carboxylic acid esters. The acidic monomers and the aromatic-vinylic monomers should be selected in such a way that the polymer has a glass transition temperature $T_g$ of between 30 and 100° C., in particular between 30 and 90° C., preferably between 55 and 65° C. The polymer preferably has a ceiling temperature in the region of the melting point, the melting range being between 80 and 150° C., in particular between 90 and 140° C., preferably between 105 and 115° C., particularly preferably around 110° C.

Suitable polymers are found in U.S. Pat. Nos. 4,013,607, 4,414,370 and in 4,529,787. Resins disclosed therein can, for example, be dissolved essentially completely if an adequate proportion, for example 80–90%, of these groups is neutralized using an aqueous solution of basic substances, such as borax, amines, ammonium hydroxide, NaOH and/or KOH. For example, a styrene-acrylic acid resin having an acid number of about 190 would contain not less than about 0.0034 equivalents of —COOH groups per gram of resin and would be dissolved essentially completely if a minimum of about 80–90% of the —COOH groups is neutralized by an aqueous alkaline solution. The acid number can be in the range between 120 and 550, 150 and 300, for example 150 to 250. The monomer combinations mentioned below are preferred: styrene/acrylic acid, styrene/maleic anhydride, methyl methacrylate/butyl acrylate/methacrylic acid, -methylstyrene/styrene/ethyl acrylate/ acrylic acid, styrene/butyl acrylate/acrylic acid, and styrene/methyl acrylate/butyl acrylate/methacrylic acid. An alkali-soluble resin comprising 68% of styrene and 32% of acrylic acid and having a molecular weight of 500–10,000 may be mentioned. Other resins have an acid number of approximately 200 and a molecular weight of approximately 1400. In general, styrene (-methylstyrene)acrylic acid (acrylate) resins have a number average molecular weight of 2500–4500 and a weight average molecular weight of 6500–9500. The acid number is 170–200. Illustrative polymers contain 60–80% by weight of aromatic monoalkenyl monomers and 40–20% by weight of (meth)acrylic acid monomers and optionally 0–20% by weight of acrylic monomer containing no carboxyl groups. Mixtures of from 10:1 to 1:2 or 1:1, preferably from 8:1 to 1:2, for example from 2:1 to 1:2, of styrene/-methylstyrene can be employed. However, copolymers which comprised significant proportions of -methylstyrene proved to be less advantageous.

The thermal transfer ribbon used for the process has a coating weight in the range from 0.8 to 5 $g/m^2 \pm 0.2$, preferably in the range from 1.6 to 2.0 $g/m^2$.

In the unimaged state, the printing-plate cylinder has a surface having hydrophilic properties all the way through. Suitable for this purpose are, for example, plasma-or flame-sprayed ceramics and/or metal surfaces, such as chrome, brass (Cu52–65% Zn48–35%, for example BOLTOMET L® Cu63Zn37) and stainless steels in the sense of high-alloy steels (in accordance with DIN 17440: 1.43xx (xx=01, 10, . . .) 1.4568, 1.44xx (xx=04, 35, 01. . .)) etc.

The wetting aid has various functions. The wetting aid is also present at the interface between the metal surface and the transferred polymer after the transfer, so that the adhesion there is increased. Finally, it smoothes the surface of the transferred polymer during fixing, i.e. during subsequent heating of the transferred polymer, so that the structure of the pixel is improved. The wetting aid is selected from solvents, such as alcohols, ketones, esters of phosphoric acid, glycol ethers and anionic surfactants, in particular alcohols and ketones, preferably ketones, particularly preferably methyl ethyl ketone. Commercial products of the abovementioned solvents are DEGDEE and DEGBBE from BASF as representatives of the glycol ethers, and arylalkylsulphonic acids as representatives of the anionic surfactants, or aliphatic esters of orthophosphoric acid, such as Etingal. The solvents used as wetting aid preferably originate from the thermal transfer ribbon production step.

Wetting aids can be introduced in small amounts (for example 0.05–8% by weight, preferably 0.5–5% by weight, of the dry weight of the donor layer) by the production process.

The erasing composition used in the present invention can basically be either a two-component acidic erasing composition or an alkaline erasing composition.

The erasing composition can, for example, be defined as a cleaning medium comprising:

(a) a substance which, in aqueous solution, is able to produced a pH of 1–4 or a substance which is able to produce a pH of 10–14, in an amount which is sufficient for the pH range mentioned, (b) a dispersible abrasive agent in an amount of 1–15 g, (c) a low-foam surfactant in an amount of 0.1–50 g, (d) a solvent in an amount of 10–50 g, (e) water to 100 g and, if desired, further additives.

The proposed pH of 1–4 of the aqueous solution of the cleaning medium employed in the present invention can be provided using conventional organic or inorganic acids. For economic reasons, inorganic acids are preferred. In particular, the inorganic acids must not have an adverse chemical effect on the printing-plate cylinder. Oxygen acids from the fifth and sixth main group of the Periodic Table of the Elements and hydrohalic acids would be conceivable. Phosphoric acid has proven particularly suitable. Phosphoric acid is physiologically relatively acceptable, is available at low cost, has a long shelf life and does not adversely effect the surface of the printing plate. It is assumed that the phosphoric acid forms relatively low-solubility phosphates and hydroxyphosphates on the surface of the printing plate which support the hydrophilization process through the formation of hydrophilic centres. The phosphoric acid has, for example, a phosphating action on steel surfaces in the range 2.8–3.6. Surface phosphates, such as hopeite ($Fe^{3}$+) and, in the presence of Zn, phosphophyllite ($ZN_2Fe^{2+}(PO_4)_2*4H_2O$) form here. Contact-angle measurement (by the method of Owens, Wendt and Rabel) on Ni- and Fe-based printing plates exhibits an increase in surface tension by about 30 mN/m and an increase in the polar content by 30% after use of the phosphoric-acid cleaners. The dipole-dipole interactions at the substrate surface which can be derived therefrom result in better wetting due to "dirty" substrate areas and to the idea, generally accepted in the paint industry, that $FePO_4*PO_4$ layers significantly improve the adhesion of a polymer coating. Furthermore, the solvency of phosphoric acid for printing ink is adequately high in combination with the other constituents mentioned above. For make-up, the abovementioned acids are employed as a solution in the concentration range from 10% to virtually 100%, in particular from 30% to 90%. For phosphoric acid, the commercially available shipping concentration, which is usually between 80 and 90%, usually about 85%, applies. Based on 100 g of cleaning medium, from 2 g to 30 g of the abovementioned acid, preferably from 4 g to 15 g, in particular from 5 g to 10 g, are employed.

In the case of an alkaline medium, any desired substances which produce a pH of ≧10 can be employed. All completely dissolved hydroxides of the alkali metals, alkaline earth metals and ammonia, ammonium and phosphonium compounds are suitable. Particular preference is given to alkali metal hydroxides and carbonates. Preference is in turn given to sodium hydroxide and potassium hydroxide, sodium hydroxide being particularly preferred. The amount of alkaline compound employed is in the range from 0.3 to 10 g, in particular from 0.5 to 5 g, particularly preferably from 0.7 to 2 g, preferably from 0.8 to 1.5 g, per 100 g of formulation. Converted to the pH, the amount of an aqueous solution employed having a concentration of from 0.5 mol/l is from 30 to 60 g per 100 g of formulation, in particular from 40 to 50 g, particularly preferably from 44 to 46 g, per 100 g of formulation.

In the case of sodium hydroxide, a particularly preferred amount is in the range from 44 to 46 g/100 g of a 0.5 mol/l NaOH solution.

The abrasive must not have an adverse effect on the printing plates during application to the printing plate or the cleaning cloth and during mechanical treatment of the printing plates. In particular, the abrasive should be built up in such a way with respect to its structure and hardness that the printing plate is not excessively adversely affected by abrasion, but the removal process for the printing-ink residues present on the printing plate, in particular encrusted printing-ink residues, and of the imaging composition is effectively supported. Furthermore, it is required that the abrasive particles of the abrasive remain in suspension for as long as possible. With respect to the abrasive particle size, it has been found that a size of <1 μm, preferably <0.1 μm, especially preferably <50 nm, particularly preferably in the range between 5 and 35 nm, in particular between 10 and 15 nm (centre of the size distribution) is particularly advantageous. With respect to the charge on the abrasive particles, the zeta potential should be at least 10 mV, in particular 20 mV, particularly preferably 35 mV. The zeta potential range should, without additives, be from 0 to 40 mV in the case of $Al_2O_3$—C at a pH of <9 and from −70 mV to +20 mV in the case of, for example, Aerosil OX50 (Degussa-Hüls) at a pH of <9. The abrasive preferably consists of metal oxides having a zeta potential, depending on the nature of the metal oxide, of greater than +10 mV or greater than −10 mV at pH=7.

The material of the abrasive particles is preferably selected from metal oxides or metal mixed oxides of the general formula $M^{III}O$, $M^{III}{}_2O_3$, $M^{IV}O_2$, $M^{II.III}{}_3O_4$, where $M^{II}$ is selected from the metals from main group II, $M^{III}$ is selected from the metals from main group III, transition metals and the lanthenides, and $M^{IV}$ is selected from the metals or metalloids from main group IV and the transition metals. Preference is given to aluminium oxide, zirconium oxide, silicon dioxide, zinc oxide and iron oxide.

The effect of the abrasives and thus their properties show a homogenization (symmetrical Abott curve) of the $R_z$ values when used on Ni- and Fe-based substrates. These effects can be determined by means of a perthometer (Fokodyn laser scanner) or white-light interferometer. In addition, suitable abrasives show a contribution in increasing the polar proportion of the surface tension after their use.

It has been found that, of the possible abrasive particles, 6-aluminium oxide, for example $Al_2O_3$—C from Degussa, is particularly suitable.

The $Al_2O_3$—C (Degussa) having a basic character (CAS 1394-28-1) is prepared by high-temperature hydrolysis of an $AlCl_3$. The primary particles thereby formed are all cubic with rounded edges (SEM) with a mean size of the primary particles of 13 nm. BET studies (DIN 66131) show no mesopores in hysteresis analyses, and the particles thus do not have an internal structure (in contrast to $\gamma$-$Al_2O_3$, which is employed in chromatography owing to its internal structure). The pH of a 4% strength by weight aqueous dispersion after removal of hydrochloric-acid impurities is greater than 7.5 (DIN ISO 787/IX) and indicates that the surface OH groups are weakly alkaline. The isoelectric point at pH=9 is thus understandable. If the pH drops to below 9, the zeta potential increases to +40 mV. At pH values of greater than 9, a negative surface charge arises (pH=10, −20 mV). The specific density of $Al_2O_3$—C is about 3.2 g/ml, and the dielectric constant is 5.

The abrasive is employed in an amount of 1–15 g, preferably 2–20 g, more preferably 2.5–8 g, and in particular 3–6 g per 100 g of formulation.

The surfactant serves, inter alia, to effect micelle formation of the oleophilic ink residues so that the oleophilic ink residues can be emulsified in water and carried away from the surface. Furthermore, the surfactant acts as emulsifier between the aqueous, acidic or alkaline phase and the hydrocarbon phase. In general, any desired surfactant is suitable for this process. Of the known ionogenic surfactants, such as cationic, anionic and ampholytic surfactants, cationic and anionic surfactants are the most suitable. It has been found that anionic surfactants which contain a polyoxyalkylene chain in their molecule are particularly suitable. A preferred class of these compounds consists of a polyoxyalkylene radical bonded to an aromatic core, which carries an acidic group, such as a sulphone, sulphate, carboxyl or phosphate group, via an alkylene bridge. Preference is given to a surfactant having a polyoxyethylene chain having from 2 to 12 ethylene oxide units, from 2 to 16 methoxide units or from 2 to 7 propoxide units bonded to an aryl radical which is substituted by a sulphate or sulphonic acid group bonded via an alkylene group. Particular preference is given to the surfactant Triton X-200. Triton X-200 essentially retains its technical properties irrespective of the pH; for example, it does not precipitate in the case of a pH change or lose a significant part of its surfactant behaviour. In addition, Triton X-200 exhibits excellent antistatic properties, as shown in the area of AgX photography. This is presumably attributable to the $SO_3Na$ group and the $(CH_2CH_2O)$ chain.

Apart from alkylpolyglycosides and alkylpolyglycol ethers, pure nonionic surfactants are of only limited suitability for the abovementioned purpose since they tend, for example, to be absorbed by metal surfaces, such as the surface of a printing plate. Nonionogenic surfactants should therefore either be avoided or only employed as co-surfactant as a mixture with the abovementioned ionogenic surfactants. Feasible mixing ratios are from 1:10 to 10:1.

In the case of an acidic formulation, the concentration of the surfactant is in the range from 0.1 to 50 g, in particular from 1 g to 50 g, per 100 g of formulation, in particular from 2 g to 10 g per 100 g of formulation, particularly preferably from 3 g to 8 g per 100 g of formulation. In the case of an alkaline formulation, the preferred range is from 0.1 to 50 g, in particular from 5 to 20 g, per 100 g of formulation, preferably from 8 to 15 g per 100 g of formulation, in particular from 9 to 12 g per 100 g of formulation.

A preferred class of surfactants is alkylarylpolyglycol ether sulphates, for example sodium alkylarylpolyether sulphonate (CAS No. 2917-94-4), Union Carbide Benelux N.V., having a CMC (critical micelle concentration, at 100% by weight) of 230 ppm.

The composition used according to the invention optionally contains a complexing agent, the complexing agent being selected from EDTA (ethylenediaminetetraacetic acid disodium salt dihydrate, ethylenedinitrilotetraacetic acid disodium salt dihydrate), EGTA (ethylene glycol bis(β-aminoethyl ether)-N,N,N',N'-tetraacetic acid, AMP (aminomethyl phosphonate), HEDP (hydroxyethylidine 1,1-diphosphonate), triethanolamine, organic acids, such as malic acid, succinic acid, citric acid, glutaric acid, adipic acid and/or oxalic acid, and mixtures thereof.

The solvent to be used for the cleaning formulation may be any desired solvent which is customary in the area of cleaning of printing plates. In particular, the solvent should have adequate solvency, but also meet the occupational hygiene and safety conditions around and in the printing machine. In order to be able to take up the ink residues and other water-insoluble residues formed during the erasure operation, the solvent should preferably be insoluble in, but emulsifiable with, the carrier substance of the formulation, namely water.

Examples of solvents which are in principle suitable art aromatic hydrocarbons, aliphatic hydrocarbons, both unbranched and branched (isohydrocarbons), esters and ketones, but also organic solvents which are substituted by heteroatoms in the chain or on the chain. Of these classes of solvents, the aliphatic solvents have proven particularly suitable for a variety of reasons. Aromatic solvents, such as toluene, mesitylene, cumene, etc., although they frequently exhibit very good results in solvency, are not preferred as the only solvent owing to physiological or toxicological doubts, but also owing to their tendency to attack plastic and rubber parts in the apparatus. A similar situation applies to halogenated hydrocarbons, which are in addition environmentally unacceptable owing to their poor degradability. It has been found that of the aliphatic solvents, the isoparaffinic solvents in particular are especially suitable. Isoparaffinic solvents in hazard class A III, in particular isoparaffinic solvents having a flash point of >60° C., are especially suitable. Of the esters, fatty acid esters, for example derived from vegetable oils, but also from animal fats, such as beef tallow, have proven particularly suitable. The fatty acid esters of vegetable origin are prepared, for example, from coconut oil, palm kernel oil, soya oil, sunflower oil, linseed oil or rapeseed oil, preferably from coconut or palm kernel oils by lipolysis followed by esterification and, if desired, transesterification with monofunctional alcohols (selected front C1–C24, preferably C1–18, more preferably C1–C14-alcohols and mixtures thereof, and for the transesterification selected from C2–C24, preferably C2–18, more preferably C2–C14, in particular C2–C10-alcohols and mixtures thereof). Preferred fatty acid esters have a Kaufmann iodine number (Deutsche Gesellschaft for Fettorshung DGF C–V 11b and according to Wiis ISO 3961) of <100, preferably from 10 to 60. In order that rubber blankets do not exhibit excessive swelling behaviour, the proportion of methyl eaters should be kept as low as possible. The alcohol partner of the ester preferably has from 2 to 24 carbon atoms, more preferably from 2 to 18 or from 2 to 10 carbon atoms. Preference is given to the fatty acid esters of the alcohols ethanol, isopropanel, n-propanol, butanols and 2-ethylhexyl ester. Then esters may be in the form of a mixture. The respective fatty acids after lipolysis are in the form of a mixture and have, for example, from 6 to 24, preferably from 8 to 18, carbon atoms. Myristic and lauric acid are the principle components of coconut oil and palm kernel oil. Commercial products for fatty acid esters are products from the EDENOR® series from Henkel and PRIOLUBE® series from Unichema.

The fatty acid esters are generally employed in a mixture in a mixing ratio of from 1:10 to 10:1, preferably from 1:3 to 3:1, more preferably from 1.5:1 to 1:1.5, in general around 1:1, with hydrocarbons of paraffinic and/or naphthenic type, for example as explained above.

Important requirements made of the ink dissolvers are redox stability, dissolution rate and solvency, as a measure of the minimum amount of solvent necessary for the same amount of ink without external influences. The ink solvency is given by the quotient of the amount of ink and the amount of solvent employed. Of the particularly suitable paraffinic (low-aromatic) hydrocarbons, saturated cyclic (for example decahydronaphthalene) and branched-chain acyclic hydrocarbons exhibit the greatest ink solvency in the 24 h sedimentation test with conventional heat set inks and different pigmentation. Of the preferred isoparaffinic hydrocarbons, Isopar L, a product from Exxon (CAS 90622-58-5), exhibits the most favourable ratio. Isopar L is a mixture of an isoparaffin fraction having a boiling point of >189° C., presumably a $C_{11}$–$C_{14}$ fraction. The flash point of Isopar L is 64° C.

The solvent is employed in an amount of 10–50 g, preferably 20–40 g, in particular 25–35 g, per 100 g of formulation.

The principle constituent of the cleaning medium used according to the invention is water. Water has the advantage of being available in virtually unlimited quantities and of being physiologically and environmentally acceptable. Furthermore, an aqueous medium supports the degree of hydrophilization necessary for re-use of the printing plate, i.e. besides the cleaning action, the cleaning medium should also preferably hydrophilize the printing plate. If desired, an additional hydrophilizing agent is omitted hereby.

Further substances which can be added to the cleaning medium are, for example, preservatives, for example of a biocidal nature, which may be present in a content of from 1 to 3% by weight, if the agent is not already sufficiently biocidal per se. Under certain circumstances, corrosion-protection agents, such as molybdate salts, orthophosphates, benzotriazoles, tolyltriazoles, triethanolamine phosphate, etc., can be employed.

The viscosity of the finished formulation to be used in the present invention is in the range from 1 to 500 $mPas^{-1}$. The viscosity is preferably in the range from 5 to 40 $mPas^{-1}$, more preferably in the range from 2 to 30 $mPas^{-1}$. The Theological behaviour is preferably designed in such a way that an application system of the novel type can be operated therewith. Excessively high viscosity, thixotropy or dilatance and inappropriate behaviour during spraying (atomization) should therefore be avoided. [Rotational rheometer (Paar Physica, MCR 300); cone and plate 1°; shear rate 50 $s-^{1}$].

The present invention is explained by the following examples.

EXAMPLE 1

In order to clean a used erasable printing plate which has been imaged by means of a laser and a thermal transfer ribbon and donor and then optionally fixed, an acidic erasing composition having the make-up indicated below was used alternately with an alkaline solution.

50 g of deionized water are mixed with 6 g/100 g of 85% strength phosphoric acid with stirring. 4 g/100 g of 6-aluminium oxide, $Al_2O_3$—C from Degussa, are subsequently added in portions with stirring. After addition of the abrasive, the surfactant is added, in this case 5 g/100 g of Triton X-200, likewise with stirring. 30 g/100 g of Isopar L are then stirred in. Finally, the remaining deionized water is added to make up to a total of 100 g. The mixture is placed in an ultrasound bath for 30 minutes and subsequently again stirred briefly. The acidic erasing composition is thus ready for use.

An imaged printing plate with printing ink residues in the ink-carrying areas is cleaned using the erasing composition. The oleophilic printing ink residues are caught principally by the acidic erasing composition. An alkaline solution of at least pH 10 is employed alternately in order to remove the image which is soluble in alkaline medium. The operations are repeated until the printing-plate surface is clean and hydrophilic. After the erasure of the printing plate with simultaneous hydrophilization, the printing plate is dried and imaged with a polymeric material by means of a laser. A thermal transfer ribbon as produced above is used for the imaging.

A HOSTAPHAN® polyethene terephthalate (PET) film from Hoechst having a thickness of 7.5 $\mu$m is coated with a composition of the following make-up using a Meyer bar to a dry layer weight of 1.8 $g/m^2$.

20% of carbon black having a black value according to DIN 55797 of 250 and 80% of polymer J682 from Johnson S. A. Polymer and an amount of methyl ethyl ketone sufficient to produce a spreadable composition are mixed. The composition is applied to the polyester film using a Meyer bar to the abovementioned dry layer weight. After the application, the film is dried. In the case of a ribbon having a width of, for example, 12 mm, it is wound up onto a spool and inserted into a ribbon station. The back of the thermal transfer ribbon produced in this way is irradiated using an IR semiconductor laser array. A plurality of plastic particles are simultaneously transferred imagewise from the thermal transfer ribbon onto the printing-plate cylinder.

The imaging is followed by fixing of the imaged printing plate by warning the printing plate to a temperature of up to 150° C., for example by inductive heating. The abovementioned acidic erasing composition is subsequently applied using a cloth-based device, and the printing plate is treated with water and dried. The printing plate is then in dry and hydrophilized form. After fixing, the water-soluble substance is applied using a device similar to the cloth-based cleaning device. The water-soluble substance used is, for example, the commercially available rubber coating with the trade name OZASOL. The layer dried at room temperature or with slight exposure to heat is then rinsed off with water, for example from the damaging solution source, before printing.

EXAMPLE 2

In order to clean a used erasable printing plate which has been imaged by means of a laser and a thermal transfer ribbon as donor and then optionally fixed, alkaline erasing composition having the make-up indicated below was used.

10 g of Triton X are added to 100 g of water, and a homogeneous mixture is prepared. 41 g of Isopar L per 100 g of formulation are added. 45 g of a 0.5 mol/l NaOH solution, likewise based on 100 g of the formulation, are subsequently added. Finally, 4 g/100 g of δ-aluminium oxide, $Al_2O_3$—C from Degussa, are added in portions with stirring. The mixture is placed in an ultrasound bath for 30 minutes and subsequently stirred briefly again. A ready-to-use, homogeneous, milky-white emulsion/dispersion which is stable for at least 24 hours is obtained.

An imaged printing plate having printing ink residues in the ink-carrying areas is cleaned using the erasing composition. After erasure of the printing ink with simultaneous hydrophilization, the printing plate is dried and imaged with a polymeric substance by means of a laser. A thermal transfer ribbon produced as below is used for the imaging.

A thermal transfer ribbon employed as in Example 1 was used. After the application, the film is dried. In the case of a ribbon having a width of, for example, 12 mm, this is wound up onto a spool and inserted into a ribbon station. The back of the thermal transfer ribbon produced in this way is irradiated using an IR semiconductor laser array. A plurality of plastic particles is simultaneously transferred imagewise from the thermal transfer ribbon to the printing-plate cylinder.

The imaging is followed by fixing of the imaged printing plate by warming the printing plate to a temperature of up to 150° C., for example by inductive heating. After the fixing, the water-soluble substance is applied using a device similar to the cloth-based cleaning device. The water-soluble substance used is, for example, the commercially available rubber coating with the trade mark Ozasol. The layer dried at room temperature or with slight exposure to heat is then rinsed off with water, for example from the damping solution source, before printing.

The printing plate treated in this way exhibits significantly better free-running behaviour with unchanged print quality and simplified process performance.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A process for the treatment of an erasable litho-graphic printing plate, comprising the steps of:

(a) treating one of a used and an unused printing plate with an erasing composition to clean said printing plate, wherein said erasing composition comprises a substance which, in aqueous solution, produces one of a pH of 1–4 and a pH of 10–14, and present in an amount which is sufficient for the stated pH range, a dispersible abrasive in an amount of 1–15 g, a low-foam surfactant in an amount of 1–50 g, a solvent in an amount of 10–50 g, and water to 100 g;

(b) laser imaging said printing plate with a polymeric substance to provide an image thereon;

(c) applying to said printing plate any one of i) a heat-curable and water-soluble substance, immediately after step b), ii) a water-soluble substance immediately after step b), and iii) a heat-curable and water-soluble substance immediately after step b), followed by warning of said printing plate;

(d) fixing said image an said priming plate; and (e) washing said water-soluble substance, or said heat-curable and water-soluble substance from said printing plate with a solution consisting essentially of water before printing with said printing plate.

2. A process according to claim 1, wherein said water-soluble substances or said heat-curable and water-soluble substance is free of image impairing substances.

3. A process according to claim 2, wherein said water-soluble substance comprises at least one of a polysaccharide, a polyalkylene glycol, a (meth) acrylamide, a polyvinylpyrrolidone, a vinyl methyl ether-maleic anhyride copolymer, a vinyl acetate-malcic anhydride copolymer.

4. A process according to claim 3, wherein said water-soluble substance includes one of a wetting agent, a noniogenic surfactant, an anionic surfactant and a plasticizer.

5. A process according to claim 4, wherein:

said polysaccharide is at least one of a maltdextrin, and a tapioca dextrin;

said polyalkylene glycol is PEG having a MW of from 200 to 1000;

the (meth) acrylamide is partially hydrolyzed, has a MW of from 100,000 to 300,000 and a proportion of 60–70% of hydrolyzed acrylic groups;

said wetting agent is any one of oligometic poly (ethylene glycol). octylphenoxypolyethoxyethanol optionally sulphonated, and nonylphenolpolyethoxyethylene glycol optionally sulphonated;

said noniongenic surfactant is any one of ethoxylated decyl alcohols, polyethoxylated nonylphenol, polyethoxylated isooctylphenol, ethoxylated sorbitan monooleate, and propoxylated isooctylphenol;

said anionic surfactant is any one of alkali metal salts of alkanol sulphates and sulphonates, alkali metal salts of elkylaryl sulphates and sulphonates; and said plasticizer is a dialkyl phthalate.

6. A process according to claim 1, wherein said water-soluble substance or said heat-curable and water-soluble substance is washed solely with said water solution, said water solution having a predetermined tack value.

7. A process according to claim 1, wherein said image comprises a polymeric substance induced by a laser and transferred from a donor element to said printing plate, said polymeric substance comprising as components (1) a substance which converts radiation energy of an incident laser light into heat energy, (2) a polymer which contains at least one of an acidic group and an optionally substituted amide group thereof, and (3) a wetting aid.

8. A process according to claim 7, wherein component (1) is at least one of an organic dye and an organic colorant having an absorption property maximum in a wavelength range from about 700 to about 1600 nm, and a heat resistance of greater than 150° C. and an inorganic substance which converts radiation energy into heat.

9. A process according to claim 8, wherein said one of said organic dye and said organic colorant comprises heat-stable organic dyes and pigments selected from beozothiazoles, quinolines, cyanine dyes and pigments, perylene dyes and pigments and polymethine dyes and pigments, including oxonole dyes and pigments and merocyanine dyes and pigments.

10. A process according to claim 7, wherein said polymer dissolves in water at a pH of greater than 10.

11. A process according to claim 7, wherein said polymer has a number average molecular weight of from 1000 to about 20,000.

12. A process according to claim 7, wherein said polymer has a surface tension of from 50 to 20 mN/m, determined by contact-angle measurement.

13. A process according to claim 7, wherein said polymer has a glass transition temperature in the range from 30 to 100° C.

14. A process according to claim 7, wherein said polymer has a ceiling temperature in a region of a melting point for all components of between 80 to 150° C.

15. A process according to claim 7, wherein said wetting aid is an organic solvent of said polymer.

16. A process according to claim 7, wherein said organic solvent is a ketone.

17. A process according to claim 1, wherein said printing plate is made of one of plasma and a flame-sprayed ceramic, and a metal surfaced, member.

18. A process according to claim 1, wherein said substance which produces a pH of 10–14 is a medium-strength to strong base in an amount of from 0.3 to 10 g.

19. A process according to claim 1, wherein said dispersible abrasive is selected from metal oxide particles having a zeta value of at least 10 mV at a pH of 7.

20. A process according to claim 1, wherein said surfactant is an anionic surfactant having a polyethylene oxide chain.

21. A process according to claim 1, further including a nonionic co-surfactant selected from alkylpolyglycosides, alkylpolyglycol ethers and alkylphenolpolyglycol ethers and mixtures thereof.

22. A processing according to clam 1, wherein said solvent is selected from paraffinic hydrocarbons, naphthenic hydrocarbons, fatty acid esters and mixtures thereof.

23. A process according to claim 1, wherein said erasing composition comprises a complexing agent.

24. A process far the treatment of an erasable lithographic printing plate comprising the steps of:

(a) treating one of a used and an unused printing plate with an erasing composition to clean said printing plate, wherein said erasing composition comprises a substance which, in aqueous solution, produces one of a pH of 1–4 and a pH of 10–14, and present in an amount which is sufficient for the stated pH range, a dispersible abrasive in an amount of 1–15 g, a low-foam surfactant in an amount of 1–50 g, a solvent in an amount of 10–50 g, and water to 100 g;

(b) laser imaging said printing plate with a polymeric substance to provide an image thereon;

(c) applying to said printing plate any one of (i) a heat-curable and water-soluble substance one of immediately before step b), and immediately before step c), (ii) a water-soluble substance one of immediately before step b) and immediately before step c), and (iii) a heat-curable and water-soluble substance one of immediately before step b) and immediately to step c), followed by warming of said printing plate, said water soluble and heat curable substance being applied with one of an application cloth and an elastic rubber roll;

(d) fixing said image on said printing plate; and (e) washing said water-soluble substance, or said heat curable and water substance from said printing plate with a solution consisting essentially of water before printing with said printing plate.

25. A process for the treatment of an erasable lithographic printing plate comprising the steps of:

(a) treating one of a used and an unused printing plate with an erasing composition to clean said printing plate, wherein said erasing composition comprises a substance which, in aqueous solution, produces one of a pH of 1–4 and a pII of 10–14, and present in an amount which is sufficient for the stated pH range, a dispersible abrasive in an amount of 1–15 g, a low-foam surfactant in an amount of 1–50 g, a solvent in an amount of 10–50 g, and water to 100 g;

(b) laser imaging said printing plate with a polymeric substance to provide an image thereon;

(c) applying to said printing plate any one of (i) a heat-curable and water-soluble substance one of immediately before step b), and immediately before step c), (ii) a water-soluble substance one of immediately before step b) and immediately before step c), and (iii) a heat-curable and water-soluble substance one of immediately before step b) and immediately before step c), followed by warming of said printing plate, said water soluble and heat curable substance being applied with a media nozzle, (d) fixing said image on said printing plate; and (e) washing said water-soluble substance, or said heat curable and water substance from said printing plate with a solution consisting essentially of water before printing with said printing plate.

* * * * *